US010378539B2

(12) United States Patent
Perevozchikov et al.

(10) Patent No.: US 10,378,539 B2
(45) Date of Patent: Aug. 13, 2019

(54) SYSTEM INCLUDING HIGH-SIDE AND LOW-SIDE COMPRESSORS

(71) Applicant: Emerson Climate Technologies, Inc., Sidney, OH (US)

(72) Inventors: Michael M. Perevozchikov, Tipp City, OH (US); Kirill M. Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 284 days.

(21) Appl. No.: 15/156,977

(22) Filed: May 17, 2016

(65) Prior Publication Data

US 2016/0258656 A1 Sep. 8, 2016

Related U.S. Application Data

(62) Division of application No. 14/189,248, filed on Feb. 25, 2014, now Pat. No. 9,611,849.

(60) Provisional application No. 61/769,255, filed on Feb. 26, 2013.

(51) Int. Cl.

| | |
|---|---|
| ***F04C 23/00*** | (2006.01) |
| ***F04C 18/02*** | (2006.01) |
| ***F25B 1/10*** | (2006.01) |
| ***F25B 9/00*** | (2006.01) |
| ***F25B 13/00*** | (2006.01) |

(Continued)

(52) U.S. Cl.

CPC ..... *F04C 23/008* (2013.01); *F04C 18/0215* (2013.01); *F04C 23/001* (2013.01); *F04C 28/02* (2013.01); *F25B 1/10* (2013.01); *F25B 9/008* (2013.01); *F25B 13/00* (2013.01); *F25B 49/02* (2013.01); *F04C 2270/24* (2013.01); *F25B 2309/061* (2013.01); *F25B 2400/0401* (2013.01); *F25B 2400/075* (2013.01)

(58) Field of Classification Search

CPC .... F25B 31/002; F25B 31/004; F25B 31/008; F04C 23/008; F04C 18/0215

See application file for complete search history.

(56) References Cited

U.S. PATENT DOCUMENTS

| | | | |
|---|---|---|---|
| 3,467,300 | A | 9/1969 | Schibbye |
| 4,662,826 | A | 5/1987 | Nitta et al. |
| 4,910,972 | A | 3/1990 | Jaster |

(Continued)

FOREIGN PATENT DOCUMENTS

| | | | |
|---|---|---|---|
| CN | 2740971 | Y | 11/2005 |
| CN | 2884061 | Y | 3/2007 |

(Continued)

OTHER PUBLICATIONS

Final Office Action regarding U.S. Appl. No. 13/930,979, dated Jan. 23, 2015.

(Continued)

*Primary Examiner* — Kenneth J Hansen

(74) *Attorney, Agent, or Firm* — Harness, Dickey & Pierce, P.L.C.

(57) ABSTRACT

A system may be operable to circulate a working fluid between first and second heat exchangers. The system may include a suction line, a low-side compressor, a high-side compressor and a discharge line. The low-side and high-side compressors may both be in fluid communication with the suction and discharge lines.

15 Claims, 4 Drawing Sheets

(51) Int. Cl.

| | |
|---|---|
| ***F25B 49/02*** | (2006.01) |
| ***F04C 28/02*** | (2006.01) |

(56) References Cited

U.S. PATENT DOCUMENTS

| | | | | |
|---|---|---|---|---|
| 5,277,554 | A | 1/1994 | Elson | |
| 6,257,840 | B1 | 7/2001 | Ignatiev et al. | |
| 6,267,572 | B1 | 7/2001 | Suefuji et al. | |
| 6,672,846 | B2 | 1/2004 | Rajendran et al. | |
| 7,201,567 | B2 | 4/2007 | Wiertz et al. | |
| RE40,400 | E | 6/2008 | Bass et al. | |
| 7,896,629 | B2 | 3/2011 | Ignatiev et al. | |
| 8,118,563 | B2 | 2/2012 | Chen et al. | |
| 9,039,396 | B2 | 5/2015 | Ignatiev | |
| 9,366,462 | B2 | 6/2016 | Perevozchikov et al. | |
| 10,094,600 | B2 | 10/2018 | Doepker et al. | |
| 2006/0078451 | A1 | 4/2006 | Kim et al. | |
| 2007/0160482 | A1 | 7/2007 | Inoue | |
| 2007/0220915 | A1 | 9/2007 | Heyl | |
| 2009/0007588 | A1 | 1/2009 | Shaw | |
| 2009/0064709 | A1 | 3/2009 | Sekiya et al. | |
| 2009/0277215 | A1 | 11/2009 | Tsuboi | |
| 2011/0138831 | A1* | 6/2011 | Ogata | F25B 9/06 62/193 |
| 2012/0100025 | A1 | 4/2012 | Watts et al. | |

FOREIGN PATENT DOCUMENTS

| | | | |
|---|---|---|---|
| CN | 101180505 | A | 5/2008 |
| CN | 101457949 | A | 6/2009 |
| CN | 102200119 | A | 9/2011 |
| CN | 203570543 | U | 4/2014 |
| DE | 10225774 | C1 | 12/2003 |
| EP | 1619389 | A2 | 1/2006 |
| EP | 1700066 | A2 | 9/2006 |
| EP | 1496258 | A3 | 4/2008 |
| EP | 2320160 | A1 | 5/2011 |
| EP | 2497954 | A2 | 9/2012 |
| FR | 2968731 | A1 | 6/2012 |
| JP | 11141483 | A | 5/1999 |
| JP | 2006307699 | A | 11/2006 |
| JP | 4158102 | B2 | 10/2008 |
| JP | 2010166807 | A | 7/2010 |
| JP | 2012215082 | A | 11/2012 |
| WO | WO-2005050107 | A2 | 6/2005 |
| WO | WO-2007123085 | A1 | 11/2007 |

OTHER PUBLICATIONS

First Office Action regarding Chinese Application No. 201310276391.5, dated May 6, 2015. Translation provided by Unitalen Attorneys at Law.

Office Action dated Aug. 29, 2014, regarding U.S. Appl. No. 13/930,979.

Office Action regarding Chinese Patent Application No. 201310276391.5, dated Nov. 25, 2015. Translation provided by Unitalen Attorneys at Law.

Office Action regarding Chinese Patent Application No. 201480010418.9, dated Jul. 5, 2016. Translation provided by Unitalen Attorneys at Law.

Office Action regarding U.S. Appl. No. 14/189,200, dated Sep. 28, 2015.

Office Action regarding U.S. Appl. No. 14/189,248, dated Feb. 9, 2016.

Office Action regarding U.S. Appl. No. 14/189,248, dated Sep. 2, 2016.

Office Action regarding U.S. Appl. No. 14/189,248, dated Sep. 25, 2015.

PCT International Search Report regarding application No. PCT/US2014/018371 dated Jul. 9, 2014.

PCT Written Opinion of the International Searching Authority regarding application No. PCT/US/2014/018371 dated Jul. 9, 2014.

Office Action regarding Chinese Patent Application No. 201480010418.9, dated Mar. 2, 2017. Translation provided by Unitalen Attorneys at Law.

Office Action regarding Chinese Patent Application No. 201710786598.5, dated Aug. 20, 2018. Translation provided by Unitalen Attorneys at Law.

Office Action regarding Indian Patent Application No. 2214/MUM/2013, dated Sep. 28, 2018.

* cited by examiner

SYSTEM INCLUDING HIGH-SIDE AND LOW-SIDE COMPRESSORS

CROSS-REFERENCE TO RELATED APPLICATIONS

This application is a divisional of U.S. patent application Ser. No. 14/189,248, filed on Feb. 25, 2014, which claims the benefit of U.S. Provisional Application No. 61/769,255, filed on Feb. 26, 2013. The entire disclosures of the above applications are incorporated herein by reference.

FIELD

The present disclosure relates to a system including high-side and low-side compressors.

BACKGROUND

This section provides background information related to the present disclosure and is not necessarily prior art.

Heat-pump systems and other working fluid circulation systems include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the compressors is desirable to ensure that the heat-pump system in which the compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a system operable to circulate fluid between first and second heat exchangers and including a suction line, a low-side compressor, a high-side compressor and a discharge line. The low-side and high-side compressors may both be in fluid communication with the suction and discharge lines.

In some embodiments, the suction line is fluidly coupled to a low-side suction inlet and a high-side suction inlet.

In some embodiments, a shell of the low-side compressor is disposed between the suction line and the high-side suction inlet, such that fluid passes through a suction chamber defined by the shell after exiting the suction line and before entering the high-side compressor.

In some embodiments, a discharge outlet of the high-side compressor feeds compressed fluid to the low-side suction inlet.

In some embodiments, the high-side suction inlet receives fluid discharged by the low-side compressor.

In some embodiments, the system includes a bypass conduit directly coupling the suction line with the high-side suction inlet.

In some embodiments, the high-side compressor includes a shell having first and second inlets. The first inlet may receive fluid from the low-side compressor at a first pressure. The second inlet may receive fluid discharged from the low-side compressor at a second pressure that is higher than the first pressure.

In some embodiments, the high-side compressor includes a compression mechanism defining at least one compression pocket that receives fluid from the first inlet and is fluidly isolated from fluid received by the high-side compressor from the second inlet.

In some embodiments, a discharge chamber of the high-side compressor and a suction chamber of the low-side compressor are at substantially equal pressures when the high-side and low-side compressors are operating at approximately one-hundred percent capacity.

In some embodiments, the system includes an oil conduit fluidly connecting oil sumps of the low-side and high-side compressors. In some embodiments, the system includes a control module controlling a valve disposed in the oil conduit. In some embodiments, the control module may be operable to control a capacity of at least one of the high-side and low-side compressors.

In some embodiments, the system includes a control module that may operate one of the low-side and high-side compressors and prevent operation of another of the low-side and high-side compressors when the system is operating in a heating mode. In some embodiments, the control module is operable to operate the other of said low-side and high-side compressors and prevent operation of the one of said low-side and high-side compressors when the system is operating in a cooling mode.

In some embodiments, the system includes an outdoor unit including an outdoor heat exchanger and one of the low-side and high-side compressors; and an indoor unit including an indoor heat exchanger and the other of the low-side and high-side compressors.

In another form, the present disclosure provides a compressor that may include a shell, a first compression mechanism and a second compression mechanism. The shell may define a first chamber containing fluid at a first fluid-pressure. The first compression mechanism may include first orbiting and first non-orbiting scrolls disposed in the first chamber and discharging compressed fluid into the first chamber at the first fluid-pressure. The second compression mechanism may include second orbiting and second non-orbiting scrolls disposed in the first chamber and defining a suction inlet and a discharge outlet. The suction inlet may receive fluid at the first fluid-pressure from the first chamber. The discharge outlet may discharge fluid at a second fluid-pressure out of the shell.

In some embodiments, the shell defines a second chamber at the second fluid-pressure. In some embodiments, the second chamber includes a discharge muffler.

In some embodiments, the compressor includes a drive-shaft disposed in the first chamber and drivingly engaging the first and second orbiting scrolls.

In some embodiments, the compressor includes a motor disposed within the shell and driving both of the first and second orbiting scrolls.

In some embodiments, the compressor includes a suction conduit extending through the shell and engaging a suction inlet of the first compression mechanism and transferring fluid at a third fluid-pressure to the first compression mechanism. The third fluid-pressure may be less than the first and second fluid-pressures.

In some embodiments, the shell defines a single lubricant sump supplying lubricant to both of the first and second compression mechanisms.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
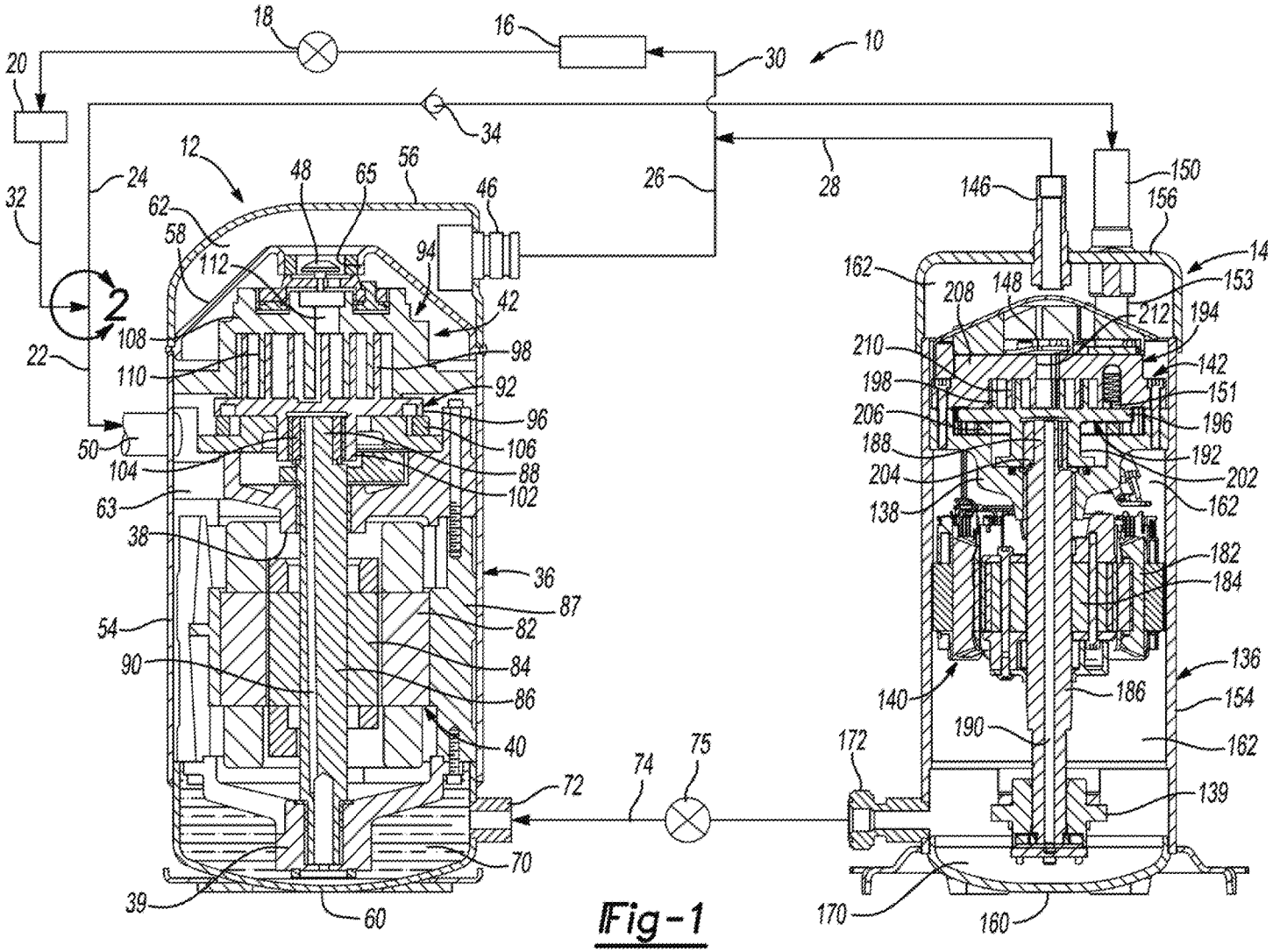
FIG. 1 is a schematic representation of a working-fluid circuit including cross-sectional views of a high-side compressor and a low-side compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a system 10 is provided and may include a low-side compressor 12, a high-side compressor 14, a first heat exchanger 16, an expansion device 18, and a second heat exchanger 20. The system 10 may be an air conditioning system, a refrigeration system, or a heat pump system, for example, and may be operable to circulate a working fluid (e.g., refrigerant, carbon dioxide, etc.) between the first and second heat exchangers 16, 20 to heat or cool a space on demand. In configurations where the system 10 is operable as a heat pump system, a reversing valve (not shown) may be provided to direct a flow of working fluid through the system 10 in a first direction in a heating mode and in a second direction in a cooling mode.

The low-side and high-side compressors 12, 14 may be in fluid communication with the first and second heat exchangers 16, 20 and may circulate working fluid through the system 10. The low-side and high-side compressors 12, 14 may receive low-pressure working fluid from first and second suction lines 22, 24, respectively, and may discharge high-pressure working fluid to first and second discharge lines 26, 28, respectively. The low-side and high-side compressors 12, 14 may be arranged in a parallel compression arrangement (or a tandem compressor arrangement).

In the operational mode depicted in FIG. 1, the first heat exchanger 16 may operate as a condenser or gas cooler and may remove heat from high-pressure working fluid received from the low-side and high-side compressors 12, 14. That is, the first heat exchanger 16 may be fluidly coupled to a main discharge line 30 that receives high-pressure working fluid from the first and second discharge lines 26, 28.

The expansion device 18 may include any suitable type of expansion device, such as an electronic expansion valve, a thermal expansion valve, a stepper motor valve, or capillary tube, for example. The expansion device 18 may be disposed between and fluidly communicate with the first and second heat exchangers 16, 20. In the depicted operational mode, the expansion device 18 may expand high-pressure working fluid received from the first heat exchanger 16. In a reversed operational mode, the expansion device 18 may expand high-pressure working fluid received from the second heat exchanger 20.

In the depicted operational mode, the second heat exchanger 20 may operate as an evaporator transferring heat to the working fluid flowing therethrough. A main suction line 32 may receive low-pressure fluid from the second heat exchanger 20 and may communicate the fluid to the low-side and high-side compressors 12, 14 via the first and second suction lines 22, 24, respectively.

It will be appreciated that in configurations where the system 10 is a heat pump system, the reversing valve may be connected to the main discharge line 30, the main suction line 32, the first heat exchanger 16 and the second heat exchanger 20. In one operational mode, the reversing valve may fluidly connect the main discharge line 30 with the first heat exchanger 16, and fluidly connect the main suction line 32 with the second heat exchanger 20 (as shown in FIG. 1). In the other operational mode, the reversing valve may fluidly connect the main discharge line 30 with the second heat exchanger 20, and fluidly connect the main suction line 32 with the first heat exchanger 16.

The low-side compressor 12 is depicted in the figures as a scroll compressor, however, in some embodiments, the low-side compressor 12 may be any other type of compressor such as a rotary, reciprocating piston, screw, or centrifugal compressor, for example. The low-side compressor 12 may include a hermetic shell assembly 36, first and second bearing assemblies 38, 39, a motor assembly 40, a compression mechanism 42, a discharge fitting 46, and a suction inlet fitting 50. The shell assembly 36 may form a compressor housing and may include a cylindrical shell 54, an end cap 56 at an upper end thereof, a transversely extending partition 58, and a base 60 at a lower end thereof. The end cap 56 and the partition 58 may define a discharge chamber 62. The partition 58 may separate the discharge chamber 62 from a suction chamber 63. The discharge chamber 62 may contain high-pressure working fluid received from the compression mechanism 42. The suction chamber 63 may contain low-pressure working fluid received from the first suction line 22.

The partition 58 may include a discharge passage 65 extending therethrough to provide communication between the compression mechanism 42 and the discharge chamber 62. A discharge valve 48 may allow compressed fluid to flow from the compression mechanism 42 to the discharge chamber 62 and may restrict or prevent fluid-flow from the discharge chamber 62 to the compression mechanism 42 or suction chamber 63. The discharge fitting 46 may be attached to the end cap 56 and may provide fluid communication between the discharge chamber 62 and the first discharge line 26. The suction inlet fitting 50 may be attached to shell assembly 36 and may provide fluid communication between the first suction line 22 and the suction chamber 63.

The base 60 of the shell assembly 36 may at least partially define a lubricant sump 70. A first lubricant fitting 72 may engage the shell assembly 36 and may provide fluid communication between the lubricant sump 70 and a lubricant conduit 74 extending between the low-side and high-side compressors 12, 14. The first lubricant fitting 72 may be disposed at any suitable location, such as at, above or below a predetermined or normal lubricant level of the lubricant sump 70.

The motor assembly 40 may be disposed within the suction chamber 63 and may include a motor stator 82, a rotor 84, and a drive shaft 86. The motor stator 82 may be press fit into a stator housing 87 or press fit directly into the shell 54. The rotor 84 may be press fit on the drive shaft 86 and may transmit rotational power to the drive shaft 86. The drive shaft 86 may be rotatably supported by the first and second bearing assemblies 38, 39. The drive shaft 86 may include an eccentric crank pin 88 and a lubricant passageway 90. Lubricant may be transmitted through the lubricant passageway 90 from the lubricant sump 70 to various compressor components such as an Oldham coupling 106, the compression mechanism 42, the first bearing assembly 38 and/or the second bearing assembly 39, for example.

The compression mechanism 42 may be disposed entirely or at least partially within the suction chamber 63 and may include an orbiting scroll 92 and a non-orbiting scroll 94. The orbiting scroll 92 may include an end plate 96 having a spiral wrap 98 extending therefrom. A cylindrical hub 102 may project downwardly from the end plate 96 and may include a drive bushing 104 disposed therein. The crank pin 88 may drivingly engage the drive bushing 104. The Oldham coupling 106 may be engaged with the orbiting and non-orbiting scrolls 92, 94 to prevent relative rotation therebetween.

The non-orbiting scroll 94 may include an end plate 108 and a spiral wrap 110 projecting downwardly from the end plate 108. The spiral wrap 110 may meshingly engage the spiral wrap 98 of the orbiting scroll 92, thereby creating a series of moving fluid pockets. The fluid pockets defined by the spiral wraps 98, 110 may decrease in volume as they move from a radially outer position (at a low pressure) to a radially intermediate position (at an intermediate pressure) to a radially inner position (at a high pressure) throughout a compression cycle of the compression mechanism 42. The end plate 108 may include a discharge passage 112 in communication with one of the fluid pockets at the radially inner position and allows compressed working fluid (at the high pressure) to flow into the discharge chamber 62.

The high-side compressor 14 is depicted in the figures as a scroll compressor, however, in some embodiments, the high-side compressor 14 could be any other type of compressor, such as a rotary, reciprocating piston, screw, or centrifugal compressor, for example. The high-side compressor 14 may include a hermetic shell assembly 136, a first and second bearing assemblies 138, 139, a motor assembly 140, a compression mechanism 142, a discharge fitting 146, and a suction inlet fitting 150. The shell assembly 136 may define a high-pressure discharge chamber 162 and may include a cylindrical shell 154, an end cap 156 at an upper end thereof, and a base 160 at a lower end thereof.

The discharge fitting 146 may be attached to the end cap 156 and may provide fluid communication between the discharge chamber 162 and the second discharge line 28. The suction inlet fitting 150 may be attached to shell assembly 136 and may fluidly couple the second suction line 24 with a suction conduit 153. The suction conduit 153 may extend through a portion of the discharge chamber 162 and provide fluid communication between the second suction line 24 and a check valve 151 at or proximate an inlet of the compression mechanism 142, while fluidly isolating the low-pressure fluid from the second suction line 24 from the high-pressure fluid in the discharge chamber 162.

The base 160 of the shell assembly 136 may at least partially define a lubricant sump 170. A second lubricant fitting 172 may engage the shell assembly 136 and may provide fluid communication between the lubricant sump 170 and the lubricant conduit 74 extending between the low-side and high-side compressors 12, 14. The second lubricant fitting 72, 172 may be disposed at any suitable location at, above or below a predetermined oil level in the sump 170. As shown in FIG. 1, the lubricant conduit 74 may include a valve 75 disposed between the first and second lubricant fittings 72, 172. The lubricant conduit 74 and valve 75 may allow for regulation of amounts of lubricant contained in the lubricant sumps 70, 170 of the low-side and high-side compressors 12, 14, respectively. In some embodiments, the valve 75 may be an electromechanical valve (e.g., a solenoid-actuated valve) controlled by a control module that may open and close the valve in response to oil levels (determined by fluid-level sensors) in the sumps 70, 170 and/or pressure differences therebetween. In some embodiments, the valve 75 may be actuated by the pressure differentials.

The motor assembly 140 may be disposed entirely within the discharge chamber 162 and may include a motor stator 182, a rotor 184, and a drive shaft 186. The motor stator 182 may be press fit into the shell 154. The rotor 184 may be press fit on the drive shaft 186 and may transmit rotational power to the drive shaft 186. The drive shaft 186 may be rotatably supported by the first and second bearing assemblies 138, 139. The drive shaft 186 may include an eccentric crank pin 188 and a lubricant passageway 190. Lubricant may be transmitted through the lubricant passageway 190 from the lubricant sump 170 to various compressor components such as the Oldham coupling 206, the compression mechanism 142, the first bearing assembly 138 and/or the second bearing assembly 139, for example.

The compression mechanism 142 may be disposed entirely within the discharge chamber 162 and may include an orbiting scroll 192 and a non-orbiting scroll 194. The orbiting scroll 192 may include an end plate 196 having a spiral wrap 198 extending therefrom. A cylindrical hub 202 may project downwardly from the end plate 196 and may include a drive bushing 204 disposed therein. The crank pin 188 may drivingly engage the drive bushing 204. The Oldham coupling 206 may be engaged with the orbiting and non-orbiting scrolls 192, 194 to prevent relative rotation therebetween.

The non-orbiting scroll 194 may include an end plate 208 and a spiral wrap 210 projecting downwardly from the end plate 208. The spiral wrap 210 may meshingly engage the spiral wrap 98 of the orbiting scroll 92, thereby creating a series of moving fluid pockets. The fluid pockets defined by the spiral wraps 198, 210 may decrease in volume as they move from a radially outer position (at a low pressure) to a radially intermediate position (at an intermediate pressure) to a radially inner position (at a high pressure) throughout a compression cycle of the compression mechanism 142. The end plate 208 may include a discharge passage 212 in communication with one of the fluid pockets at the radially inner position and allows compressed working fluid (at the high pressure) to flow into the discharge chamber 162. A discharge valve 148 may provide selective fluid communication between the discharge passage 212 and the discharge chamber 162.

It will be appreciated that either or both of the low-side and high-side compressors 12, 14 may include some form of capacity modulation, such as mechanical modulation and/or vapor injection, for example, to vary the output of one or both of the low-side and high-side compressors 12, 14. In some embodiments, the system 10 may include more than one low-side compressor 12 and/or more than one high-side compressor 14. One or more of the compressors 12, 14 may have different capacities than one or more of the other compressors 12, 14. One or more of the compressors 12, 14 may include a fixed-speed or variable-speed motor.

Figure 2:
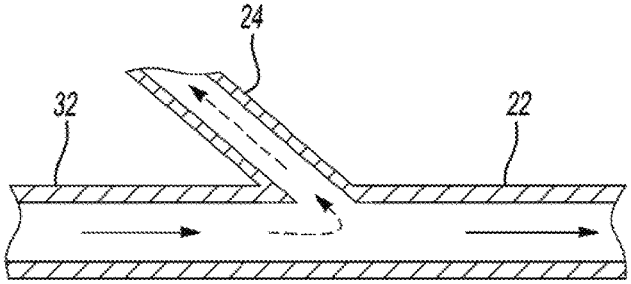
FIG. 2 is a partial cross-sectional view of a suction-gas passageway according to the principles of the present disclosure.

As shown in FIG. 2, the main suction line 32 and the first suction line 22 may form a generally straight and/or a generally unrestricted flow path. By contrast, the second suction line 24 may be angled relative to the main suction line 32 so that fluid flowing from the main suction line 32 will make a turn that is greater than ninety degrees to enter the second suction line 24. In this manner, if and when a mixture of liquid and vapor working fluid flows through the main suction line 32 toward the low-side and high-side compressors 12, 14, all or a substantial portion of the liquid working fluid may bypass the second suction line 24 and flow through to the first suction line 22, and vapor working fluid may flow into the second suction line 24. This is because the liquid working fluid will have a higher inertia than the vapor working fluid, which hinders the ability of the liquid working fluid from making the greater-than-ninety-degree turn into the second suction line 24. The lighter vapor working fluid may not be hindered by the greater-than-ninety-degree turn as much as the liquid working fluid may be. In this manner, vapor working fluid may be supplied to the suction fitting 150 and suction conduit 153 of the high-side compressor 14, while more of the liquid working fluid may be supplied to the suction fitting 50 and suction chamber 63 of the low-side compressor 12. Therefore, liquid working fluid received into the suction chamber 63 of the low-side compressor 12 may cool the motor assembly 40 and/or other components of the low-side compressor 12 before being drawn into the compression mechanism 42. Some or all of the liquid working fluid received in the suction chamber 63 may evaporate (change phase to vapor working fluid) as it cools the motor assembly 40 prior to entering the compression mechanism 42. The structure of the main suction line 32 and the first and second suction lines 22, 24 described above may reduce or prevent liquid working fluid from entering the high-side compressor 14, which may reduce or prevent liquid working fluid from washing away lubricant from moving parts of the compression mechanism 142.

It will be appreciated that, in some embodiments, the angle between the main suction line 32 and the second suction line 24 may be greater or less than the angle shown in FIG. 2. For example, in some embodiments, the angle may be about ninety degrees or less than ninety degrees.

As shown in FIG. 1, the second suction line 24 may include a check valve 34 disposed between the main suction line 32 and the suction fitting 150 of the high-side compressor 14. The check valve 34 may allow fluid flow toward the suction fitting 150 and restrict or prevent fluid from flowing from the suction fitting 150 to the main suction line 32 or the first suction line 22. In some embodiments, the second suction line 24 may not include the check valve 34.

Figure 3:
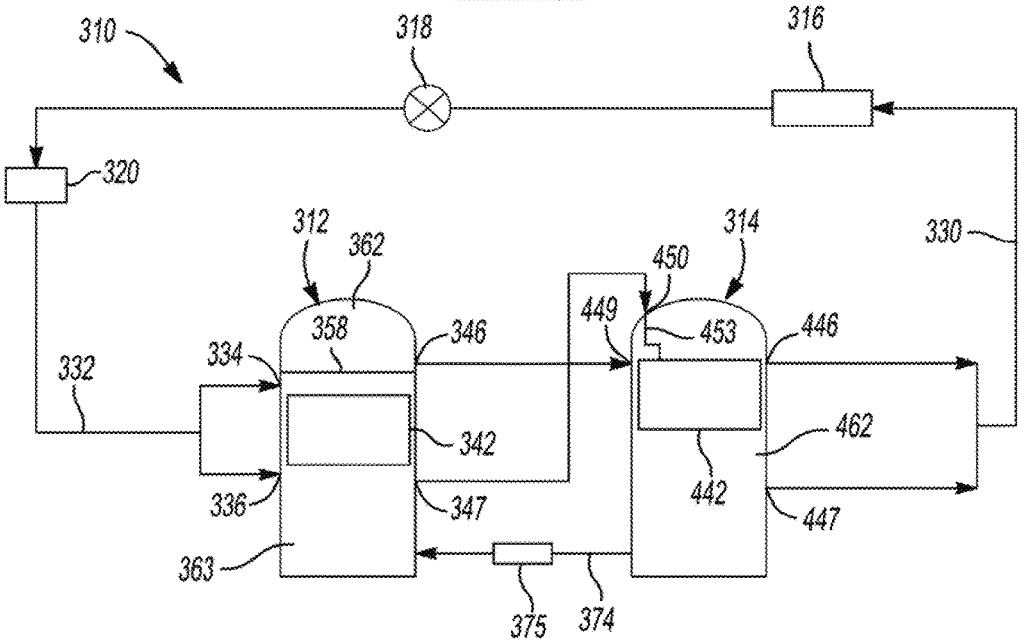
FIG. 3 is a schematic representation of another working-fluid circuit including high-side and low-side compressors according to the principles of the present disclosure.

With reference to FIG. 3, another system 310 is provided that may include a low-side compressor 312, a high-side compressor 314, a first heat exchanger 316, an expansion device 318, and a second heat exchanger 320. The low-side and high-side compressor 312, 314 may be arranged in a parallel compression arrangement. The structure and function of the compressors 312, 314, heat exchangers 316, 320 and expansion device 318 may be generally similar to that of the compressors 12, 14, heat exchangers 16, 20 and expansion device 18 described above, apart from any exceptions noted below and/or shown in the figures. Therefore, similar features will not be described again in detail.

Like the system 10, the system 310 may include a main discharge line 330 and a main suction line 332. The main suction line 332 of the system 310 may be fluidly connected to first and second suction fittings 334, 336 of the low-side compressor 312. In some embodiments, both the first and second suction fittings 334, 336 may provide low-pressure (suction pressure) working fluid to a suction chamber 363 of the low-side compressor 312. In some embodiments, the first and second suction fittings 334, 336 could be combined to form a single fitting. In some embodiments, the first suction fitting 334 may be coupled with a suction conduit (not shown) connected directly to an inlet of a compression mechanism 342 of the low-side compressor 312 that substantially fluidly isolates some or all of the fluid therein from the suction chamber 363 (e.g., similar to the configurations disclosed in Assignee's commonly owned U.S. Provisional Application No. 61/761,378, the disclosure of which is incorporated by reference herein).

The low-side compressor 312 may include a discharge fitting 346 and an outlet fitting 347. Similar to the discharge fitting 46, the discharge fitting 346 may be in fluid communication with the discharge chamber 362 and may receive compressed working fluid discharged from the compression mechanism 342. A portion of the suction-pressure working fluid in the suction chamber 363 may exit the low-side compressor 312 through the outlet fitting 347. The discharge chamber 362 and the suction chamber 363 may be separated by a partition 358.

The high-side compressor 314 may include a suction fitting 450, first and second discharge fittings 446, 447, and an inlet 449. Suction-pressure working fluid from the outlet 347 of the low-side compressor 312 may be received by the suction fitting 450. The suction fitting 450 may be coupled to a compression mechanism 442 of the high-side compressor 314 via a suction conduit 453. Like the suction conduit 153, the suction conduit 453 may maintain the suction-pressure working fluid therein substantially fluidly isolated from the discharge-pressure working fluid in the discharge chamber 462.

The first and second discharge fittings 446, 447 and the inlet 449 may be in fluid communication with the discharge chamber 462 of the high-side compressor 314. Discharge-pressure working fluid from the discharge fitting 346 of the low-side compressor 312 may be received into the discharge chamber 462 of the high-side compressor 314 through the inlet 449. Discharge-pressure working fluid may exit the discharge chamber 462 of the high-side compressor 314 through the first and second discharge fittings 446, 447 and flow into the main discharge line 330. In some embodiments, the first and second discharge fittings 446, 447 may be combined to form a single discharge fitting supplying fluid to the main discharge line 330.

A lubricant conduit 374 may be in fluid communication with lubricant sumps of the low-side and high-side compressors 312, 314. A valve 375 may control flow through the lubricant conduit 374 to regulate lubricant levels in the lubricant sumps of the low-side and high-side compressors 312, 314.

With continued reference to FIG. 3, operation of the system 310 will be described in detail. Suction-pressure working fluid from the second heat exchanger 320 may flow into the main suction line 332. From the main suction line 332, the suction-pressure working fluid may flow into the suction chamber 363 of the low-side compressor 312 through the first and second suction fittings 334, 336. A first portion of the working fluid in the suction chamber 363 may be drawn into and compressed in the compression mechanism 342. This working fluid may be discharged from the compression mechanism 342 into the discharge chamber 362. From the discharge chamber 362, discharge-pressure working fluid may exit the low-side compressor 312 through the discharge fitting 346 and flow into the discharge chamber 462 of the high-side compressor 314 through the inlet 449. In this manner, the discharge chamber 462 of the high-side compressor 314 may act as an oil separator and/or muffler for the low-side compressor 312 during operation of the high-side compressor 314 and/or while the high-side compressor 314 is not operating (i.e., shutdown). While the high-side compressor 314 is not operating and the low-side compressor 312 is operating, at least one check valve (not shown) disposed between the outlet 347 of the low-side compressor 312 and the outlet of compression mechanism 442 of the high-side compressor 314 may restrict or prevent a reverse flow condition through the system 310. For example, this check valve may be internal or external to the high-side compressor 314 and may be similar to the discharge valve 148 of the high-side compressor 14 in FIG. 1.

A second portion of the working fluid in the suction chamber 363 may exit the low-side compressor 312 through the outlet 347 and may flow into the suction fitting 450 for subsequent compression in the compression mechanism 442 of the high-side compressor 314. Accordingly, the suction chamber 363 of the low-side compressor 312 may act as a suction-line-liquid-accumulator for the high-side compressor 314 during operation of the low-side compressor 312 and/or while the low-side compressor 312 is not operating (while the low-side compressor 312 is shutdown, a majority or all of the working fluid may enter the suction chamber 363 through the second inlet 336). Working fluid is compressed in the compression mechanism 442 of the high-side compressor 314 and is discharged from the compression mechanism 442 into the discharge chamber 462. From the discharge chamber 462, the discharge-pressure working fluid exits the high-side compressor 314 through the one or both of the first and second discharge fittings 446, 447 and may flow into the main discharge line 330. As described above, working fluid may flow from the main discharge line 330 to the first heat exchanger 316, then to the expansion device 318 and back to the second heat exchanger 320.

Figure 4:
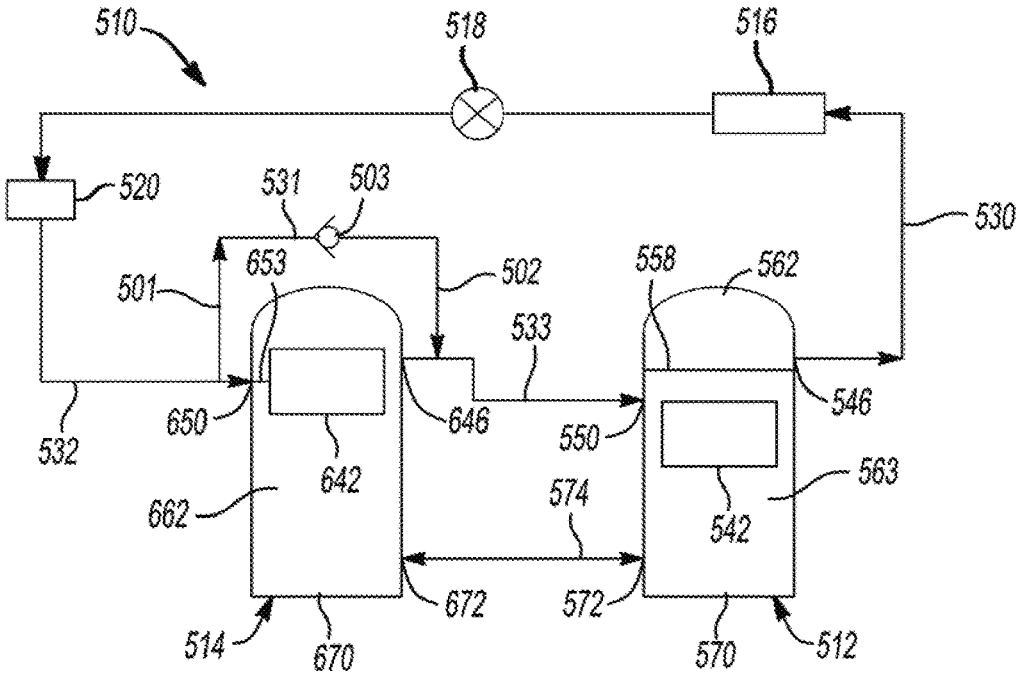
FIG. 4 is a schematic representation of another working-fluid circuit including high-side and low-side compressors according to the principles of the present disclosure.

With reference to FIG. 4, another system 510 is provided that may include a low-side compressor 512, a high-side compressor 514, a first heat exchanger 516, an expansion device 518, and a second heat exchanger 520. The structure and function of the compressors 512, 514, heat exchangers 516, 520 and expansion device 518 may be generally similar to that of the compressors 12, 14, heat exchangers 16, 20 and expansion device 18 described above, apart from any exceptions noted below and/or shown in the figures. Therefore, similar features will not be described again in detail.

The system 510 may operate in a first mode in which the high-side and low-side compressors 514, 512 operate as first and second compressor stages (i.e., a series compression arrangement in which the low-side compressor 512 may further compress working fluid that has been compressed by the high-side compressor 514). The system 510 may also operate in second mode in which the high-side compressor 514 may be shut down or deactivated, in which case working fluid may bypass the high-side compressor 514, as will be described in more detail below.

The high-side compressor 514 may include a compression mechanism 642 disposed in a discharge chamber 662 and a suction conduit 653 coupling the suction fitting 650 with the compression mechanism 642. The compression mechanism 642 may compress working fluid received from the suction conduit 653 and discharge the compressed working fluid into the discharge chamber 662. From the discharge chamber 662, the compressed working fluid may exit the high-side compressor 514 through a discharge fitting 646.

The low-side compressor 512 may include a compression mechanism 542 that may be entirely or at least partially disposed in a suction chamber 563. The compression mechanism 542 may draw in working fluid from the suction chamber 563, compress the working fluid, and discharge the working fluid into a discharge chamber 562. The suction chamber 563 and the discharge chamber 562 may be separated by a partition 558. From the discharge chamber 562, the working fluid may exit the low-side compressor 512 through a discharge fitting 546. A lubricant conduit 574 may be disposed between first and second lubricant fittings 572, 672 and may provide fluid communication between oil sumps 570, 670 of the low-side and high-side compressors 512, 514, respectively. The first and second lubricant fittings 572, 672 may be disposed at, above or below a predetermined lubricant level in sumps 570, 670

The system 510 may include a main suction line 532, a main discharge line 530, a suction bypass line 531, and an inter-stage line 533. The main suction line 532 may be in fluid communication with the suction bypass line 531 and the suction fitting 650 of the high-side compressor 514. The suction bypass line 531 may include a first end 501 fluidly coupled to the main suction line 532 and a second end 502 fluidly coupled to the inter-stage line 533. A check valve 503 may be disposed between the first and second ends 501, 502 and may allow fluid-flow from the first end 501 to the second end 502 when a fluid pressure in the first end 501 is greater than a fluid pressure in the second end 502 (e.g., when the high-side compressor 514 is deactivated and the low-side compressor 512 is operating). The check valve 503 may restrict or prevent fluid-flow from the second end 502 to the first end 501. The inter-stage line 533 may fluidly couple the discharge fitting 646 of the high-side compressor 514 with the suction fitting 550 of the low-side compressor 512. The main discharge line 530 may receive working fluid from the discharge fitting 546 of the low-side compressor 512.

With continued reference to FIG. 4, operation of the system 510 will be described in detail. As described above, the system 510 may be operable in a first mode in which both compressors 512, 514 are operating and the low-side compressor 512 further compresses working fluid that has been compressed by the high-side compressor 514 and a second mode in which the high-side compressor 514 is shut down and the low-side compressor 512 is operating.

When the system 510 is operating in the first mode, working fluid at a first, low pressure may flow from the main suction line 532 into the suction fitting 650 of the high-side compressor 514. From the suction fitting 650, the working fluid is drawn into the compression mechanism 642 and compressed to a second pressure that is higher than the first pressure. The working fluid at the second pressure may be discharged to the discharge chamber 662 before flowing out of the high-side compressor 514 through the discharge fitting 646 and into the inter-stage line 533. From the inter-stage line 533, the working fluid at the second pressure may flow into the suction chamber 563 of the low-side compressor 512 through the suction fitting 550. From the suction chamber 563, the working fluid at the second pressure may be drawn into the compression mechanism 542 of the low-side compressor 512 and further compressed to a third pressure that is higher than the second pressure. The working fluid at the third pressure may be discharged from the compression mechanism 542 into the discharge chamber 562 before flowing out of the low-side compressor 512 through the discharge fitting 546 and into the main discharge line 530.

In the first mode, a fluid pressure within the discharge chamber 662 of the high-side compressor 514 may be substantially equal to the fluid pressure within the suction chamber 563 of the low-side compressor 512. Therefore, pressure on both sides of the lubricant conduit 574 may be substantially equal. This pressure equality may promote equalization of the oil levels in the lubricant sumps 670, 570 of the high-side and low-side compressors 514, 512.

When the system 510 is operating in the second mode, working fluid at the first pressure may flow from the main suction line 532 into the first end 501 of the suction bypass line 531. Because the high-side compressor 514 may be deactivated in the second mode and the low-side compressor 512 may be operating in the second mode, the working fluid from the main suction line 532 may be drawn through the suction bypass line 531 by the compression mechanism 542, and therefore, little or no working fluid may enter the suction fitting 650. From the first end 501 of the suction bypass line 531, the working fluid at the first pressure may flow through the check valve 503 and into the inter-stage line 533 and subsequently into the suction chamber 563 of the low-side compressor 512 through the suction fitting 550. From the suction chamber 563, the working fluid may be drawn into the compression mechanism 542 and compressed therein from the first pressure to a pressure that is higher than the first pressure and lower than the third pressure. From the compression mechanism 542, the working fluid may be discharged into the discharge chamber 562 and may flow out of the low-side compressor 512 through the discharge fitting 546 into the main discharge line 530.

Figure 5:
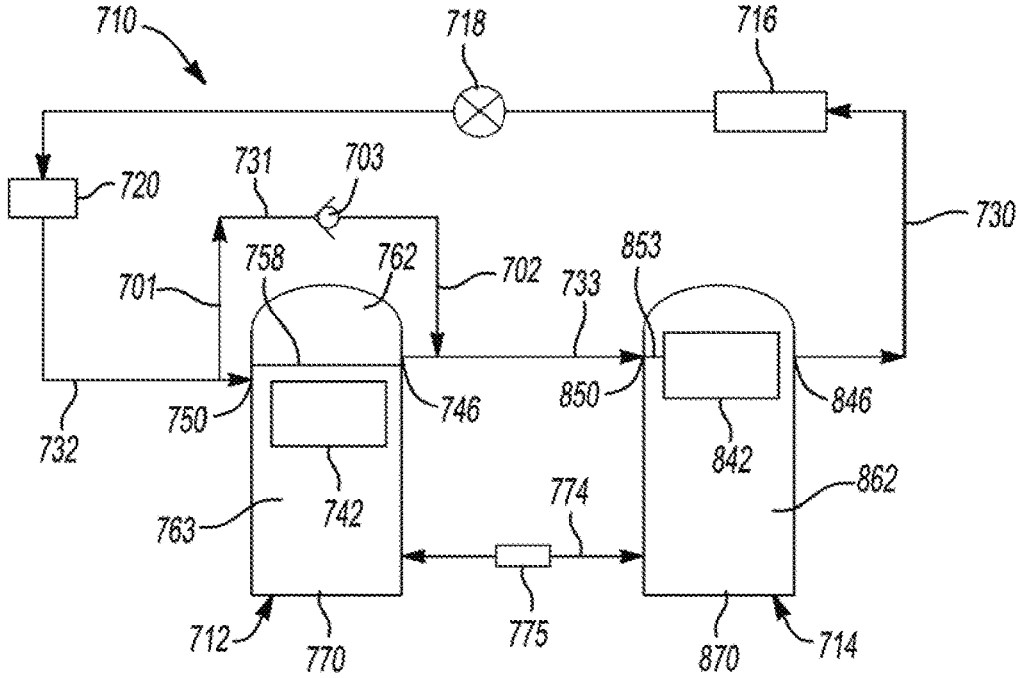
FIG. 5 is a schematic representation of another working-fluid circuit including high-side and low-side compressors according to the principles of the present disclosure.

With reference to FIG. 5, another system 710 is provided that may include a low-side compressor 712, a high-side compressor 714, a first heat exchanger 716, an expansion device 718, and a second heat exchanger 720. The structure and function of the compressors 712, 714, heat exchangers 716, 720 and expansion device 718 may be generally similar to that of the compressors 12, 14, heat exchangers 16, 20 and expansion device 18 described above, apart from any exceptions noted below and/or shown in the figures. Therefore, similar features will not be described again in detail.

The system 710 may operate in a first mode in which the low-side and high-side compressors 712, 714 operate as first and second compressor stages (i.e., the high-side compressor 714 may further compress working fluid that has been compressed by the low-side compressor 712). The system 710 may also operate in second mode in which the low-side compressor 712 may be shut down or deactivated, in which case working fluid may bypass the low-side compressor 712, as will be described in more detail below.

The high-side compressor 714 may include a compression mechanism 842 disposed in a discharge chamber 862 and a suction conduit 853 coupling the suction fitting 850 with the compression mechanism 842. The compression mechanism 842 may compress working fluid received from the suction conduit 853 and discharge the compressed working fluid into the discharge chamber 862. From the discharge chamber 862, the compressed working fluid may exit the high-side compressor 714 through a discharge fitting 846.

The low-side compressor 712 may include a compression mechanism 742 that may be entirely or at least partially disposed in a suction chamber 763. The compression mechanism 742 may draw in working fluid from the suction chamber 763, compress the working fluid, and discharge the working fluid into a discharge chamber 762. The suction chamber 763 and the discharge chamber 762 may be separated by a partition 758. From the discharge chamber 762, the working fluid may exit the low-side compressor 712 through a discharge fitting 746. A lubricant conduit 774 may provide fluid communication between oil sumps 770, 870 of the low-side and high-side compressors 712, 714, respectively.

The system 710 may include a main suction line 732, a main discharge line 730, a suction bypass line 731, and an inter-stage line 733. The main suction line 732 may be in fluid communication with the suction bypass line 731 and the suction fitting 750 of the low-side compressor 712. The suction bypass line 731 may include a first end 701 fluidly coupled to the main suction line 732 and a second end 702 fluidly coupled to the inter-stage line 733. A check valve 703 may be disposed between the first and second ends 701, 702 and may allow fluid-flow from the first end 701 to the second end 702 when a fluid pressure in the first end 701 is greater than a fluid pressure in the second end 702 (e.g., when the low-side compressor 712 is deactivated and the high-side compressor 714 is operating). The check valve 703 may restrict or prevent fluid-flow from the second end 702 to the first end 701. The inter-stage line 733 may fluidly couple the discharge fitting 746 of the low-side compressor 712 with the suction fitting 850 of the high-side compressor 714. The main discharge line 730 may receive working fluid from the discharge fitting 846 of the high-side compressor 714.

With continued reference to FIG. 5, operation of the system 710 will be described in detail. As described above, the system 710 may be operable in a first mode in which both compressors 712, 714 are operating and the high-side compressor 714 further compresses working fluid that has been compressed by the low-side compressor 712 and a second mode in which the low-side compressor 712 is shut down and the high-side compressor 714 is operating.

When the system 710 is operating in the first mode, working fluid at a first, low pressure may flow from the main suction line 732 into the suction fitting 750 of the low-side compressor 712. From the suction fitting 750, the working fluid flows in the suction chamber 763 and is drawn into the compression mechanism 742 and compressed to a second pressure that is higher than the first pressure. The working fluid at the second pressure may be discharged to the discharge chamber 762 before flowing out of the low-side compressor 712 through the discharge fitting 746 and into the inter-stage line 733. From the inter-stage line 733, the working fluid at the second pressure may flow into the high-side compressor 714 through the suction fitting 850. From the suction fitting 850, the working fluid at the second pressure may be drawn through the suction conduit 853 into the compression mechanism 842 of the high-side compressor 714 and further compressed to a third pressure that is higher than the second pressure. The working fluid at the third pressure may be discharged from the compression mechanism 842 into the discharge chamber 862 before flowing out of the high-side compressor 714 through the discharge fitting 846 and into the main discharge line 730.

In the first mode, a fluid pressure within the discharge chamber 862 of the high-side compressor 714 may be higher than the fluid pressure within the suction chamber 763 of the low-side compressor 712. Therefore, the pressure differential across the lubricant conduit 774 may promote lubricant flow from the lubricant sump 870 of the high-side compressor 714 to the lubricant sump 770 of the low-side compressor 712. Therefore, lubricant that is transferred from the low-side compressor 712 to the high-side compressor 714 with the discharged working fluid through the inter-stage line 733 may be returned to the low-side compressor 712 through the lubricant conduit 774. In some embodiments, a control valve 775 may communicate with fluid level sensors (not shown) within the low-side and high-side compressor 712, 714 and may control fluid flow through the lubricant conduit 774 to maintain a generally equal or predetermined oil level in the low-side and high-side compressors 712, 714.

When the system 710 is operating in the second mode, working fluid at the first pressure may flow from the main suction line 732 into the first end 701 of the suction bypass line 731. From the first end 701 of the suction bypass line 731, the working fluid at the first pressure may flow through the check valve 703 and into the inter-stage line 733 and subsequently into the suction fitting 850 of the high-side compressor 714. From the suction fitting 850, the working fluid may be drawn into the compression mechanism 842 and compressed therein from the first pressure to a pressure that is higher than the first pressure and lower than the third pressure. From the compression mechanism 842, the working fluid may be discharged into the discharge chamber 862 and may flow out of the high-side compressor 714 through the discharge fitting 846 into the main discharge line 730.

Figure 6:
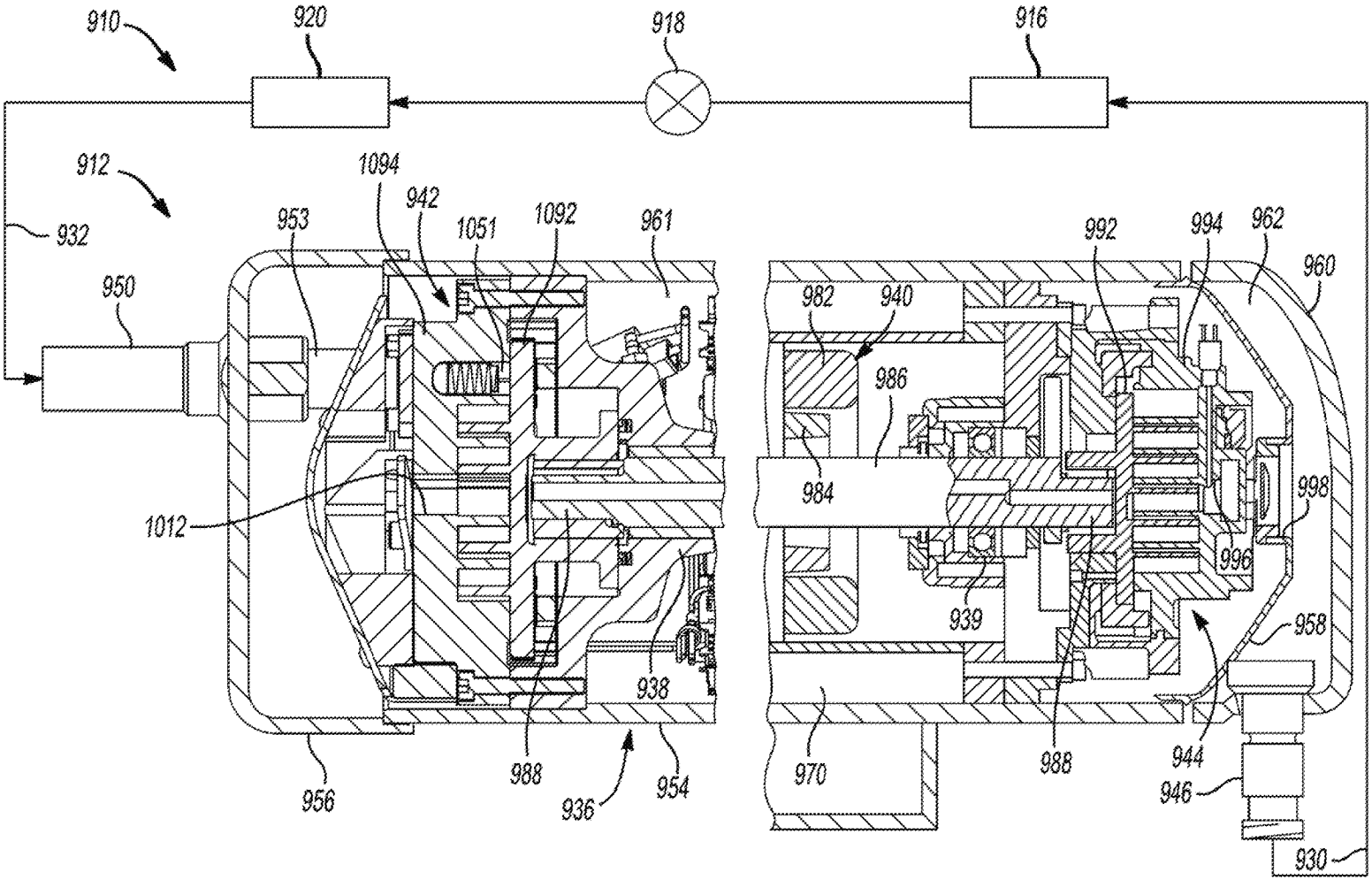
FIG. 6 is a partial cross-sectional view of a compressor including first and second compression mechanisms according to the principles of the present disclosure.

With reference to FIG. 6, another system 910 is provided that may include a compressor 912, a first heat exchanger 916, an expansion device 918, a second heat exchanger 920, a discharge line 930 and a suction line 932. The structure and function of heat exchangers 916, 920 and expansion device 918 may be generally similar to that of the heat exchangers 16, 20, expansion device 18, discharge line 30 and suction line 32 described above, apart from any exceptions noted below and/or shown in the figures. Therefore, similar features will not be described again in detail.

The compressor 912 may include a hermetic shell assembly 936, first and second bearing assemblies 938, 939, a motor assembly 940, a first compression mechanism 942, a second compression mechanism 944, a discharge fitting 946, and a suction inlet fitting 950. The shell assembly 936 may form a compressor housing and may include a cylindrical shell 954, a first end 956, a transversely extending partition 958, and a second end 960. The shell 954 may define a lubricant sump 970. The first end 956, the shell 954 and the partition 958 may define a first chamber 961. The second end 960 and the partition 958 may define a second chamber 962. The partition 958 may separate the second chamber 962 from the first chamber 961. The first chamber 961 may contain compressed working fluid received from the first compression mechanism 942. The second chamber 962 may contain further compressed working fluid received from the second compression mechanism 944.

The motor assembly 940 may be received within the shell assembly 936 and may include a stator 982, a rotor 984, and a drive shaft 986 fixed to the rotor 984. The drive shaft 986 may be rotatably supported by the first and second bearing assemblies 938, 939 and may drive both of the first and second compression mechanisms 942, 944. Each end of the drive shaft 986 may include a crank pin 988 drivingly engaging a respective one of the first and second compression mechanisms 942, 944.

The first compression mechanism 942 may be generally similar to the compression mechanism 142 described above and may include an orbiting scroll 1092 and a non-orbiting scroll 1094. The non-orbiting scroll 1094 may include a suction inlet 1051 that is coupled to the suction fitting 950 by a suction conduit 953. As described above, working fluid flowing through the suction fitting 950 and suction conduit 953 may be substantially fluidly isolated from the first chamber 961. The non-orbiting scroll 1094 may include a discharge passage 1012 in communication with the first chamber 961.

The second compression mechanism 944 may be generally similar to the compression mechanism 42 described above and may include an orbiting scroll 992 and a non-orbiting scroll 994. The non-orbiting scroll 994 may include a discharge passage 996. Working fluid may be discharged from the second compression mechanism 944 through the discharge passage 996 and may flow into the second chamber 962 through an opening 998 in the partition 958.

With continued reference to FIG. 6, operation of the compressor 912 will be described in detail. Working fluid at a first, low pressure may flow from the suction line 932 to the suction fitting 950. From the suction fitting 950, the working fluid may flow through the suction conduit 953 and into the first compression mechanism 942. The first compression mechanism 942 may compress the working fluid to a second pressure that is higher than the first pressure and discharge the working fluid into the first chamber 961.

Working fluid at the second pressure in the first chamber 961 may be drawn in the second compression mechanism 944 and may be compressed therein to a third pressure that is higher than the second pressure. The working fluid at the third pressure may be discharged from the second compression mechanism 944 to the second chamber 962 and may exit the compressor 912 through the discharge fitting 946.

It will be appreciated that any of the systems 10, 310, 510, 710, 910 could be reversible heat pump systems. It will be appreciated that one or both of the compressors and/or compression mechanisms of the systems 10, 310, 510, 710, 910 may be modulated, may include vapor injection, and/or a variable-speed motor, for example, and/or additional or alternative components or features for varying their capacities. Additionally or alternatively, within a given system 10, 310, 510, 810, the low-side and high-side compressors 12, 14, 312, 314, 512, 514, 712, 714 may have different capacities or displacements than each other. Similarly, the compression mechanisms 942, 944 may have different capacities or displacements than each other within the system 910.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system operable to circulate fluid between first and second heat exchangers and including a suction line, a low-side compressor, a high-side compressor and a discharge line, said low-side and high-side compressors both being in fluid communication with said suction and discharge lines, wherein said suction line is fluidly coupled to a low-side suction inlet and a high-side suction inlet, wherein a discharge outlet of said high-side compressor feeds compressed fluid to said low-side suction inlet, wherein said high-side compressor includes a first shell assembly and a first compression mechanism disposed within said first shell assembly, said first shell assembly defines a first discharge-pressure chamber that receives said compressed fluid discharged from said first compression mechanism, and wherein said first compression mechanism is disposed within said first discharge-pressure chamber, and wherein said low-side compressor includes a second shell assembly and a second compression mechanism disposed within said second shell assembly, wherein said second shell assembly defines a suction-pressure chamber and a second discharge-pressure chamber, said second compression mechanism fluidly separates said suction-pressure chamber from said second discharge-pressure chamber, said suction-pressure chamber receives fluid from said low-side suction inlet and said second discharge-pressure chamber receives fluid discharged from said second compression mechanism, and wherein said second compression mechanism is disposed within said suction-pressure chamber.

2. The system of claim 1, wherein said first discharge-pressure chamber of said high-side compressor and said suction-pressure chamber of said low-side compressor are at substantially equal pressures when said high-side and low-side compressors are operating at approximately one-hundred percent capacity.

3. The system of claim 1, wherein an oil sump of said low-side compressor is disposed within said suction-pressure chamber, and an oil sump of said high-side compressor is disposed within said first discharge-pressure chamber.

4. The system of claim 3, further comprising an oil conduit fluidly connecting said oil sumps of said low-side and high-side compressors.

5. The system of claim 1, wherein said low-side compressor includes a motor disposed within said suction-pressure chamber and drivingly engaged with said second compression mechanism.

6. The system of claim 5, wherein said high-side compressor includes another motor disposed within said first discharge-pressure chamber and drivingly engaged with said first compression mechanism.

7. The system of claim 1, further comprising a bypass conduit directly coupling said suction line with said low-side suction inlet.

8. A system operable to circulate fluid between first and second heat exchangers and including a suction line, a low-side compressor, a high-side compressor and a discharge line, said low-side and high-side compressors both being in fluid communication with said suction and discharge lines, wherein said suction line is fluidly coupled to a low-side suction inlet and a high-side suction inlet, wherein said high-side suction inlet receives fluid discharged by said low-side compressor, the system including a bypass conduit directly coupling said suction line with said high-side suction inlet such that fluid is able to flow from said suction line to said high-side suction inlet via said bypass conduit, wherein said high-side compressor includes a first shell assembly and a first compression mechanism disposed within said first shell assembly, wherein said first shell assembly defines a first discharge-pressure chamber, and wherein said first compression mechanism is disposed within said first discharge-pressure chamber, and wherein said low-side compressor includes a second shell assembly and a second compression mechanism disposed within said second shell assembly, wherein said second shell assembly defining a suction-pressure chamber and a second discharge-pressure chamber, and wherein said second compression mechanism is disposed within said suction-pressure chamber.

9. The system of claim 8, wherein said second shell assembly of said low-side compressor is disposed between said suction line and said high-side suction inlet, such that fluid passes through a suction chamber defined by said second shell assembly after exiting said suction line and before entering said high-side compressor.

10. The system of claim 8, wherein an oil sump of said low-side compressor is disposed within said suction-pressure chamber, and an oil sump of said high-side compressor is disposed within said first discharge-pressure chamber.

11. The system of claim 10, further comprising an oil conduit fluidly connecting oil sumps of said low-side and high-side compressors.

12. The system of claim 8, wherein said low-side compressor includes a motor disposed within said suction-pressure chamber and drivingly engaged with said second compression mechanism.

13. The system of claim 12, wherein said high-side compressor includes another motor disposed within said first discharge-pressure chamber and drivingly engaged with said first compression mechanism.

14. The system of claim 11, further comprising a valve disposed on said oil conduit.

15. The system of claim 14, wherein said valve is electronically controlled to regulate oil levels within said oil sumps of said low-side and high-side compressors.

* * * * *